US007434277B1

(12) United States Patent
Brennan et al.

(10) Patent No.: US 7,434,277 B1
(45) Date of Patent: Oct. 14, 2008

(54) FLUID FLOW SYSTEM

(75) Inventors: Anthony Brennan, Clifton Park, NY (US); W. John Gardenier, Albany, NY (US)

(73) Assignee: Saratoga Spa & Bath, Inc., Latham, NY (US)

( * ) Notice: Subject to any disclaimer, the term of this patent is extended or adjusted under 35 U.S.C. 154(b) by 1156 days.

(21) Appl. No.: 10/055,513

(22) Filed: Jan. 23, 2002

(51) Int. Cl.
*A61H 33/02* (2006.01)

(52) U.S. Cl. ..... 4/541.4; 4/541.6; 4/559

(58) Field of Classification Search ..... 4/541.4, 4/541.6, 559
See application file for complete search history.

(56) References Cited

U.S. PATENT DOCUMENTS

| | | | | | |
|---|---|---|---|---|---|
| 1,982,258 | A | | 11/1934 | Martin | 4/541.4 |
| 1,982,259 | A | | 11/1934 | Martin | 4/541.4 |
| 1,982,260 | A | * | 11/1934 | Martin | 4/559 X |
| 1,982,261 | A | * | 11/1934 | Martin | 4/559 X |
| 3,345,982 | A | * | 10/1967 | Guiler | 4/541.4 X |
| 3,948,252 | A | | 4/1976 | Montagne | 4/541.6 X |
| 4,101,988 | A | * | 7/1978 | Sierant | 4/541.4 |
| 4,340,982 | A | * | 7/1982 | Hart et al. | 4/541.4 X |
| 4,420,846 | A | | 12/1983 | Bonner | 4/541.4 |
| 4,422,191 | A | | 12/1983 | Jaworski | 4/541.6 X |
| 5,000,665 | A | | 3/1991 | Moeller | 4/541.6 X |
| 5,547,129 | A | | 8/1996 | Fortunato et al. | 239/566 X |
| 5,662,467 | A | | 9/1997 | Jones | 239/566 X |
| 5,862,543 | A | | 1/1999 | Reynoso et al. | 4/541.6 |
| 5,943,711 | A | | 8/1999 | Loizeaux et al. | 4/541.6 |
| 6,134,722 | A | | 10/2000 | Lowry et al. | 4/541.1 |
| 6,182,303 | B1 | | 2/2001 | Gardenier et al. | 4/541.6 |

* cited by examiner

*Primary Examiner*—Robert M Fetsuga
(74) *Attorney, Agent, or Firm*—Heslin Rothenberg Farley & Mesiti P.C.; Nicholas Mesiti, Esq.; Victor A. Cardona

(57) ABSTRACT

A fluid flow system for a hydrotherapy tub includes a body adapted for mounting to the hydrotherapy tub. The body includes a water chamber adapted for fluid communication with a water source, an air chamber adapted for fluid communication with an air source, and a plurality of outlets in fluid communication with the water chamber and the air chamber. The plurality of outlets is configured to transmit water from the water chamber and air from the air chamber to an interior of the hydrotherapy tub.

15 Claims, 5 Drawing Sheets

FLUID FLOW SYSTEM

TECHNICAL FIELD

This invention relates, in general, to hydrotherapy tubs and, in particular, to systems and methods for creating fluid flow in hydrotherapy tubs.

BACKGROUND ART

Hydrotherapy tubs, spa assemblies and like systems have enjoyed increased popularity in recent years. In the majority of such systems, a contained space is at least partially filled with a fluid, such as water, which continuously is circulated throughout the contained space. A fluid directing structure is provided to include one or more jet streams of water directed into the interior of the contained space to create a certain amount of water turbulence.

In a conventional spa assembly or system, the tub or pool like structure is generally formed of rigid material and permanently mounted or fixed either in ground or above ground at a specific location. Fixed plumbing in the form of rigid material conduits, pumps, heating structure, etc. are then mounted at this given location in communication with the interior of the rigid material tub or pool to create the desired treatment of water being circulated. Hydrotherapy tubs generally have a number of fluid flow outlets or nozzles. Each flow nozzle usually jets water or a water-air froth into the tub. Enhanced hydrotherapy typically results from strategic positioning of these fluid flow nozzles at various locations in the tub. The one or more flow nozzles located throughout the tub generally direct single streams of water from each nozzle to specific locations of the user which aids in hydrotherapy of that location.

Some fluid flow nozzles have the user controlled ability to direct a single jet stream of water into multiple positions, by rotating or pivoting the fluid flow nozzle. However, providing hydrotherapy to multiple areas at the same time or providing multiple jet streams to a certain area is limited by the number and placement of the fluid flow nozzles which typically each provide a single jet stream of water and/or air. To provide a desirable hydrotherapeutic effect it is often desirable to provide multiple jets streams of water and/or air to a certain area of a user's body. In general, these nozzles have been individually placed in specific locations by the manufacturer and cannot be relocated without significant work and expense. Therefore, if a user wishes to provide hydrotherapy to two or more locations at the same time and/or to provide multiple jet streams to a certain area, there may be difficultly due to nozzle placement.

Thus, a need exists for a technique to direct multiple jet streams in one or more general directions or to provide multiple jet streams to a certain area of a hydrotherapy tub using a minimum number of parts. A need also exists for providing multiple nozzles and jet streams typically of water and air, through a minimum number of access holes in the surface of the tub housing.

SUMMARY OF THE INVENTION

The present invention provides, in a first aspect a fluid flow system for a hydrotherapy tub which includes a body adapted for mounting to a hydrotherapy tub. The body includes a first chamber adapted for fluid communication with a water source, a second chamber adapted for fluid communication with an air source, and a plurality of outlets in fluid communication with the first chamber and the second chamber. The plurality of outlets is configured to transmit water from the first chamber and air from the second chamber to an interior portion of the hydrotherapy tub. The air is fed to the body from a single air source while the water is fed to the body from a single water source. In accordance with the present invention, the body, which is mountable on the tub, allows water and air from single respective sources to be ejected into the tub through multiple outlets. Thus, the body allows for multiple air water froth outlets without using multiple holes in the tub to supply air and water to the same outlets.

The present invention provides, in a second aspect, a fluid flow system for a hydrotherapy tub which includes a body adapted for mounting to a hydrotherapy tub and at least one outlet. The body includes a water chamber adapted for fluid communication with a water source and air chamber adapted for fluid communication with an air source, preferably an ambient air source. The at least one outlet is adapted to receive water from the water chamber and to draw air from the air chamber and the at least one outlet is configured to transmit the water and the air to an interior of the hydrotherapy tub.

The present invention provides, in a third aspect, the fluid flow system for a hydrotherapy tub which includes a body adapted for mounting to the hydrotherapy tub. The body includes a water inlet, an air inlet, and means for providing a plurality of jets of water-air froth to an interior of the hydrotherapy tub.

The present invention provides, in a fourth aspect, a method for controlling fluid flow of a hydrotherapy tub. The method includes providing a body adapted for mounting to the hydrotherapy tub wherein the body includes an air inlet, a water inlet, and means for providing a plurality of jets of water-air froth to an interior of the hydrotherapy tub from the body.

The present invention provides, in a fifth aspect, a method for controlling fluid flow of a hydrotherapy tub wherein the method includes providing a body adapted to be mounted to the hydrotherapy tub and adapted to receive water and ambient air, and providing a plurality of jets of water-air froth to an interior of the hydrotherapy tub body from the body.

BRIEF DESCRIPTION OF THE DRAWINGS

The subject matter which is regarded as the invention is particularly pointed out and distinctly claimed in the claims at the conclusion of the specification. The foregoing and other objects, features, and advantages of the invention will be readily understood from the following detailed description of preferred embodiments taken in conjunction with the accompanying drawings in which:

DETAILED DESCRIPTION OF ONE PREFERRED EMBODIMENT OF THE INVENTION

In accordance with the principles of the present invention, fluid flow systems for a hydrotherapy tub or spa and methods of controlling fluid flow are provided.

Figure 1:
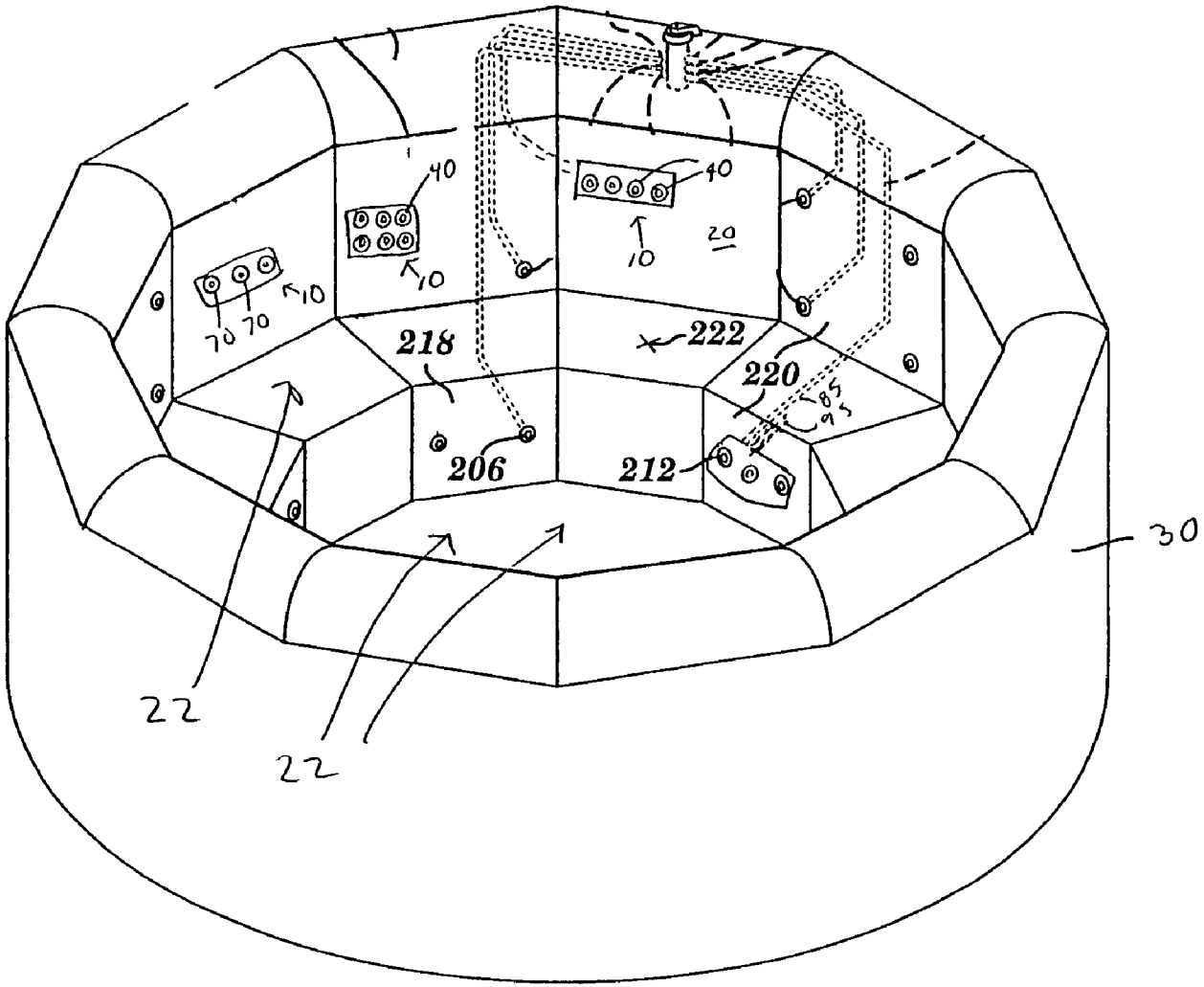
FIG. 1 is a perspective view of a hydrotherapy tub including a fluid flow system in accordance with the present invention.
Figure 2:
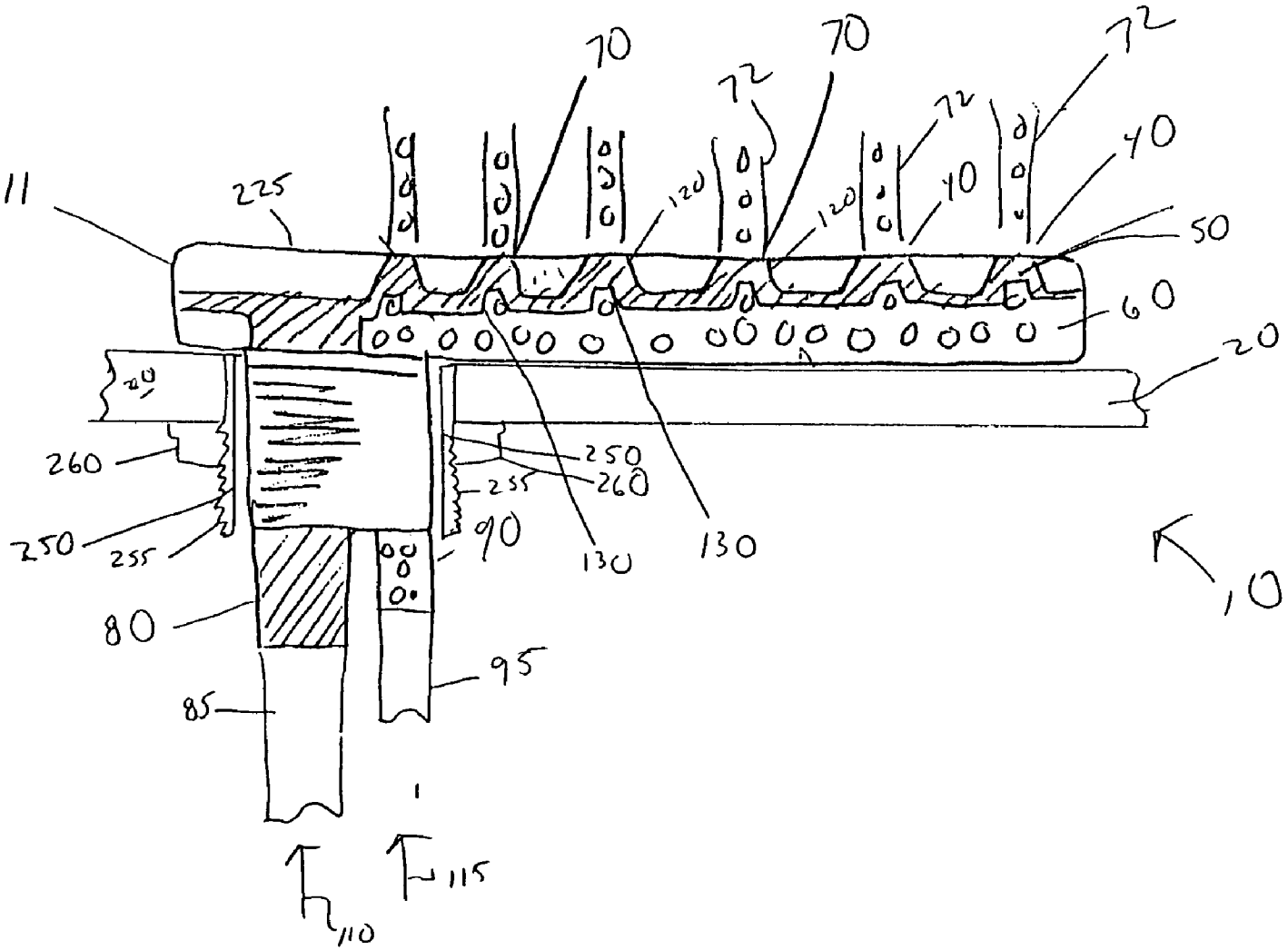
FIG. 2 is a side cross-sectional view of the fluid flow system of FIG. 1.
Figure 3:
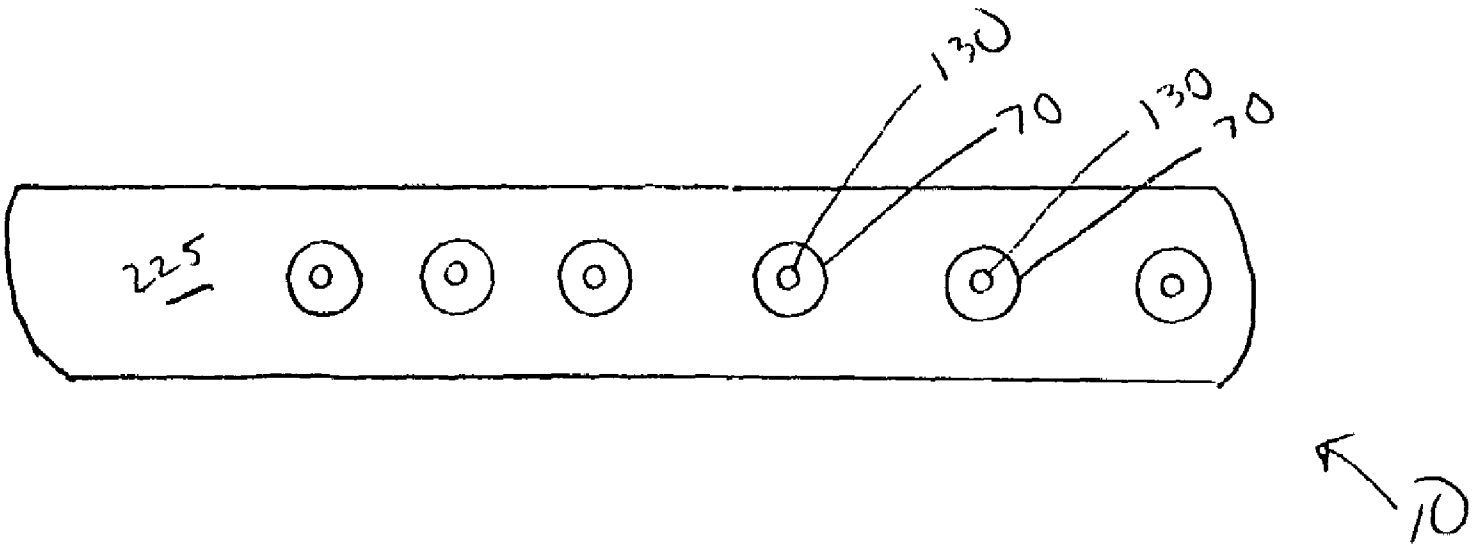
FIG. 3 is a top elevational view of the fluid flow system of FIG. 1.

In an exemplary embodiment depicted in FIGS. 1-3, a fluid flow system 10 may include a body 11 mounted on a wall 20 or other surface of a spa or hydrotherapy tub 30. As shown in FIG. 2, fluid flow system 10 includes a first chamber 50 adapted for fluid communication with a water source (referred to as "the water chamber"), a second chamber 60 adapted for fluid communication with an air source (referred to as "the air chamber"), and a plurality of outlets 70 in fluid communication with the water chamber and the air chamber. Outlets 70 are configured to transmit water from water chamber 50 and air from air chamber 60 to an interior 22 of hydrotherapy tub 30.

Fluid flow system 10 receives water and air through a first inlet 80 and a second inlet 90, respectively. First inlet 80 is in fluid communication with a supply of water and second inlet 90 is in fluid communication with a supply of air via water conduit 85 and air conduit 95, respectively. A conduit 85 is preferably connected to a pressurized source of water and another conduit 95 is connected to an air source, preferably to an ambient and/or unpressurized source of air. In one example, second inlet 90 may be connected directly to a source of ambient air via conduit 95. In another example, second inlet 90 might be directly connected to an inside portion (not shown) of hydrotherapy tub 30 located opposite tub wall 20 from interior 22 (FIG. 1) via conduit 95 or other means. The inside portion may be in fluid communication with ambient air outside the inside portion, via a conduit, for example. Alternatively, other fluids besides air and water, respectively, might enter first inlet 80 and second inlet 90. For example, both inlets might be supplied with water, or one of the inlets might be supplied with a soapy water. Also, air might be supplied to inlet 80 and water to inlet 90, so that air enters chamber 50 and water enters chamber 60.

In one embodiment, water and air enter in the directions of arrows 110 and 115 through water inlet 80 and air inlet 90, respectively. The water is directed to water chamber 50 and the air is directed to air chamber 60. As is evident from FIG. 2, water chamber 50 may overlay air chamber 60 such that water chamber 50 is closer to the interior of tub 30 and air chamber 60 abuts or is adjacent to wall 20 of hydrotherapy tub 30, when fluid flow system 10 is mounted thereto. Water chamber 50 may also include a series of conical structures 120 adjacent to outlets 70. Interfaces or air outlets 130 between water chamber 50 and air chamber 60 may be present at center portions of conical structures 120. Mixing between the water and the air may occur in the water chamber 50 and within conical structures 120 downstream of air outlets 130. Air outlets 130 may be circular openings between water chamber 50 and air chamber 60 or cylindrical structures extending from air chamber 60 into water chamber 50, for example. The water and/or air may be discharged, preferably as a froth, through outlets 70 to the interior of tub 30. Preferably, the outlets are configured to cause the jets of water and air to flow in a direction towards the interior of the tub or spa, as in convention non-coplaner flow nozzles.

The discharge of water and air through outlets 70 may be caused by a force of pressurized water in water chamber 50. This discharge may be in the form of jets 72 of water and/or air from outlets 70. The mixing of water and air may be caused by a venturi effect due to the relationship between air outlets 130 and corresponding outlets 70 so that pressurized water flowing from water chamber 50 through outlets 70 will draw air from air outlets 130. In one example, the interior of water and air chambers, near outlets 70, 130 resemble the shape of conical structures 120. The flow of pressurized water through conical structures 120 may serve to draw air from air chamber 60 through air outlets 130. Conical structures 120 may resemble a venturi. For example, conical structures 120 may be tapered so that constrict or narrow along the direction of flow, to cause an increase in velocity of the water flowing therethrough to effect a decrease in pressure that may draw air from air chamber 60 through air outlets 130. Thus, a jet of water-air froth is discharged to the interior of hydrotherapy tub 30 from each of conical structures 120. Referring to FIG. 3, in one embodiment each of outlets 70 is concentric to each respective air outlet of air outlets 130. Thus, the centers of outlets 70 are the same as the centers of air outlets 130.

By providing a water-air froth from a plurality of outlets, which are in fluid flow relationship to at least two chambers located within one housing allows for beneficial hydrotherapy to be provided to a user. For example, several jet streams of water-air froth may be provided by fluid flow system 10 to a certain portion of the user's body, for example, the back, to provide a massage thereto. These streams of water-air froth might be less forceful and might cover a larger surface area relative to a single stream discharged from a different fluid flow device. Thus, a massage effect might be realized.

Outlets 70 may include nozzles of any shape or size, for example, slotted nozzles. It is preferred that outlet 70 be shaped so that fluid flowed under pressure through one of the chambers 50 or 60, draws fluid from the other chamber when such chamber is not pressurized. Also, system 10 may include any number of outlets 70. The number of outlets useable for such a system may depend upon the desired velocity of the jets created by such outlets and the size of the pump used to supply fluid, e.g., water, to chamber 50. For example, as is evident from FIG. 1, system 10 may include four outlets arranged longitudinally, three outlets arranged longitudinally, or two rows of three outlets arranged longitudinally. Further, system 10 may include outlets 70 adapted to direct water and/or air in any number of directions. For example, each of outlets 70 may direct water to a single body part of a user.

Alternatively, each of outlets 70 of system 10 may direct water in a direction different from each other outlet. Also, removable nozzles (not shown) might also facilitate selectivity of the flow direction of outlets 70 through substitution of one removable nozzle for another.

Figure 4:
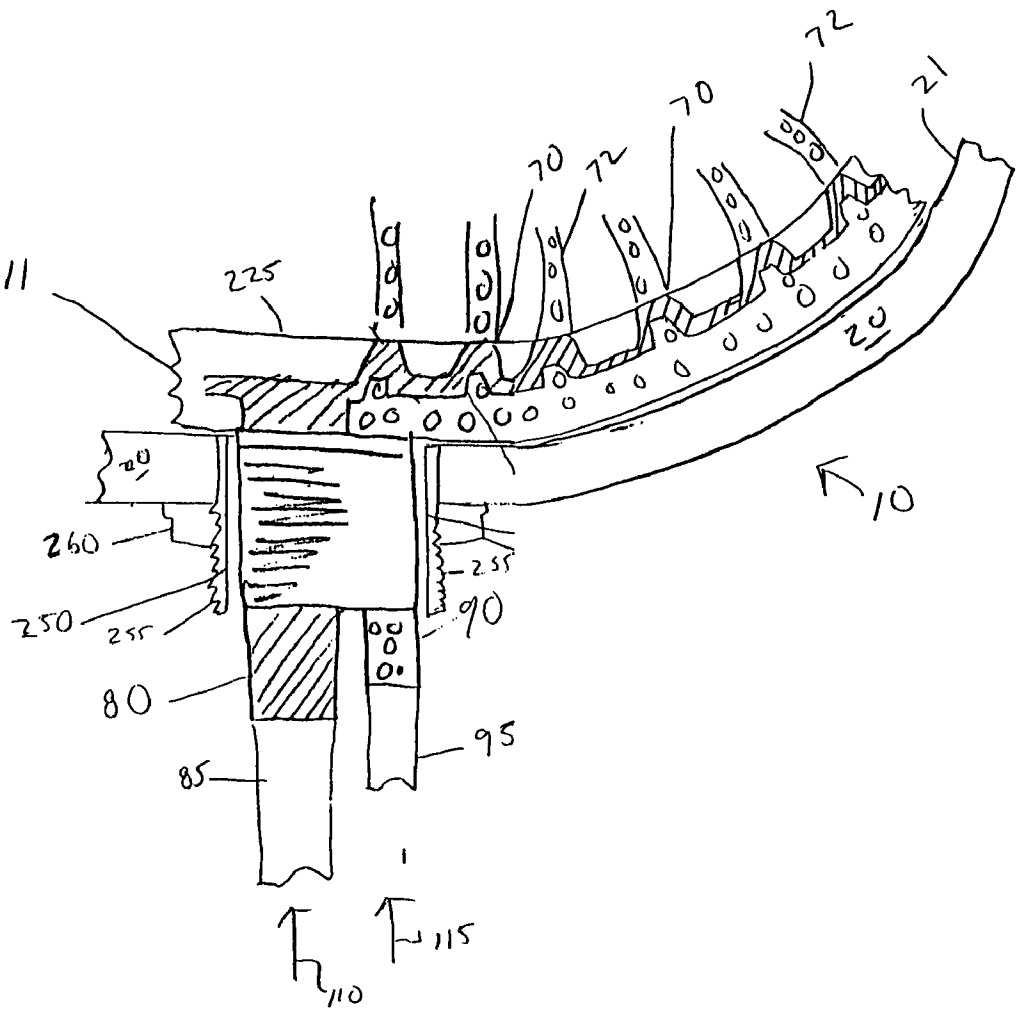
FIG. 4 is a side cross-sectional side view of a different embodiment of a fluid flow system in accordance with the present invention.

Furthermore, system 10 may be shaped to conform to an inner surface 21 of tub wall 20, as depicted in FIG. 4. For example, a top portion 225 of fluid flow system 10 may be formed to match the contour of inner surface 21. Outlets 70 may also be adapted to discharge in different directions due to a contour of inner surface 21 and top portion 225. For example, jets 72 of water-air froth from outlets 70 may be directed about perpendicular to inner surface 21. Conforming the shape of the system to inner surface 21 of the hydrotherapy tub or spa allows the plurality of outlets 70 to be in direct contact with different parts of the body of a user, if desired.

Figure 5:
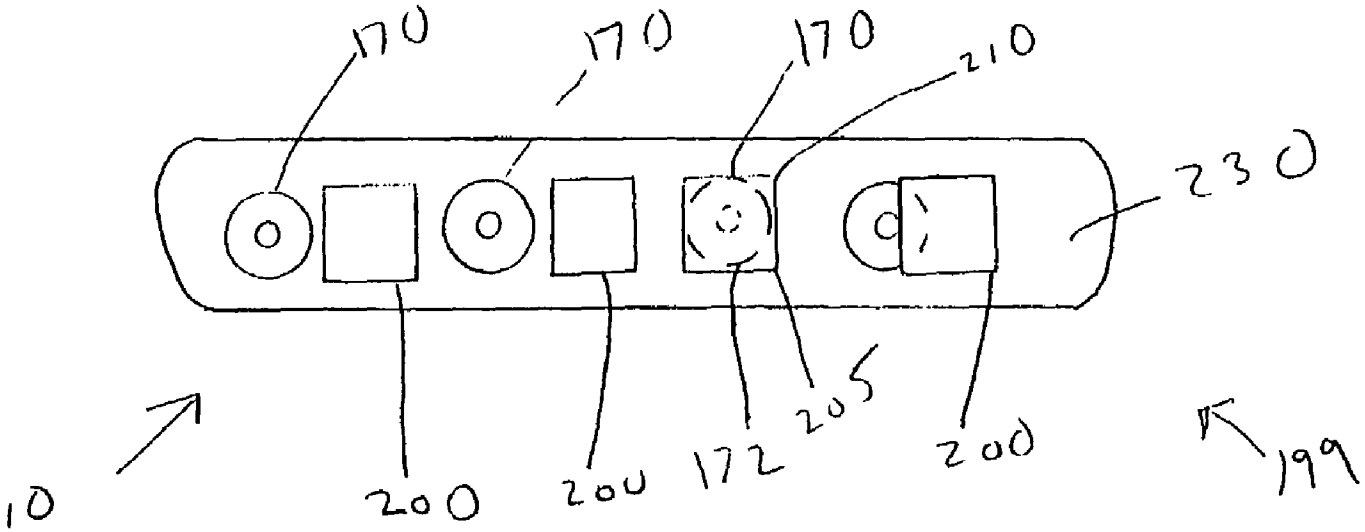
FIG. 5 is a top elevational view of another embodiment of a fluid flow system in accordance with the present invention.

In another embodiment of the present invention, fluid flow through outlets 170 might be blocked by outlet covers 200, as depicted in FIG. 5. One or more outlet covers 200 might be movably attached to a top portion 230 of a fluid flow system 199 to allow a user to select flow through one or several of a plurality of outlets 170. For example, the user might slide an outlet cover 205 of outlet covers 200 to cover outlet 172 of outlets 170, as illustrated in FIG. 5. Thus, water and/or air would be prevented from flowing through outlet 172 to the interior of hydrotherapy tub 30 by outlet cover 210. Alternatively, outlet 172 might be only partially covered by outlet cover 210 thus allowing a portion of the flow to outlet 172 to flow to the interior of hydrotherapy tub 30.

By covering or uncovering one or more of outlets 170 with outlet covers 200, various hydrotherapeutic effects might be realized. For example, covering or uncovering a particular number of outlets 170 might cause a variation in an intensity of the jet(s) of water-air froth produced, relative to a different number of outlets. Differences in water and/or air pressure in fluid flow system 199 may result from differences in the number of outlets uncovered in combination with a constant pressure water source. Such differences in pressure may cause such variations in the intensity of force of jets of water-air froth produced, as will be understood by those skilled in the art. Thus, the user might customize the number of jets and/or intensity of jets emanating from fluid flow system 199.

As will be understood by those skilled in the art, outlet covers 200 may be attached to top portion 230 in any of a variety of ways. Also, fluid flow system 199 may include any number of outlet covers 200 which may correspond to and may cover any number of outlets. Further, each outlet cover 200 may cover one or more outlets 170 of a given time. Moreover, system 199 may be identical to system 10 described above except for the moveable attachment thereto of outlet covers 170.

Furthermore, returning to FIG. 2, fluid flow system 10 may include sidewalls 250 surrounding inlets 80 and 90. For instance, sidewalls 250 may include exterior threads 255 for mating with a nut 260 to securely position fluid flow system 10 on tub wall 20.

In one example, fluid flow system 10 is mounted to tub wall 20 using epoxy or a similar water-tight sealant. The epoxy forms a fluid-tight seal that safeguards the contents of the hydrotherapy tub. In one preferred embodiment, the epoxy affixes fluid flow system 10 in a position that extends through part of tub wall 20. The body, epoxy, and chamber cooperate to further provide a safe housing for the secure fastening of inlets 80 and 90 to respective fluid supply conduits. Fluid flow system 10 may be affixed in a recess of tub wall 20.

In one embodiment, the various components, layers, or parts of fluid flow system 10 are molded of ABS plastic. As one example, any number of parts of the fluid flow system 10 may be injection-molded. For instance, any number of the parts of the fluid flow system may be unitary and/or integral. In one example, inlets 80 and 90 and/or tub wall 20 with threads 255 may be unitary and/or integral, such as may be done by injection molding. As another example, one may selectively secure the system parts by techniques such as heating or gluing. For instance, layers/plates/portions could be heated along certain interfaces.

A hydrotherapy tub may be equipped with multiple cooperating instances of hydrotherapy-tub fluid flow systems (e.g. such as fluid flow system 10 or fluid flow system 199), in accordance with the present invention. For instance, several of the fluid flow systems may be positioned in parallel in order to advantageously provide flow in the form of substantially parallel jets of injected fluid, as well as directional flow in one or multiple directions as selected by the user. The tub contours already anticipate and promote desirable postures of users in seated and reclined positions. The fluid flow systems further promote hydrotherapy by providing multiple jets of water and air froth to a particular portion of the user's body for massaging, as well as in other user selected directions to aid in hydrotherapy of additional body areas.

While part(s) of the description herein, for explanatory purposes, may imply certain exemplary direction(s), such direction(s) may be considered relative. For example referring to FIG. 5, by covering or uncovering certain of outlets 170, the direction of the fluid flow may vary. Therefore by using different numbers of outlets 170 pointed in different directions, the user may customize the directional fluid flow to suit particular hydrotherapy needs by selectively covering or uncovering particular outlets by positioning outlet covers 200. Design choice(s) allow accommodation(s) of any orientation(s) for any device(s) in accordance with the principles of the present invention.

Numerous alternative embodiments of the present invention exist. For instance, threaded interconnections could easily mount fluid flow system 10 (FIGS. 1-3) on spa wall 20 (FIGS. 1-3), or fasten air inlet 90 (FIG. 2) and water inlet 80 (FIG. 2) to fluid supply conduits. Further, the fluids could easily be liquid or gas. Moreover, each fluid could easily include a group of fluids. Additionally, any number of the systems (e.g., fluid flow system 10) could easily be secured by mechanisms such as tub wall 20 (FIGS. 1-3) with mating threads 255 and nut 260 (FIG. 2). Furthermore, fluid flow system 10 (FIGS. 1-3) and outlets 70 thereof could easily be fixed in any desired directions relative to a given incline of tub wall 20 (FIGS. 1-3).

Although preferred embodiments have been depicted and described in detail herein, it will be apparent to those skilled in the relevant art that various modifications, additions, substitutions and the like can be made without departing from the spirit of the invention and these are therefore considered to be within the scope of the invention as defined in the following claims.

The invention claimed is:

1. A fluid flow system for a hydrotherapy-tub, said system comprising:

a body configured to be attached to a hydrotherapy tub having an opening through a surface of said tub such that said body covers the opening and said body is immovable and affixed to said surface during operation, said body comprising:

a water inlet and an air inlet;

a first chamber said water inlet configured to extend through the opening to transmit water to said first chamber through the opening;

a second chamber, said air inlet configured to extend through the opening to transmit air to said second chamber through the opening;

a plurality of outlets in fluid communication with said first chamber and said second chamber;

wherein said plurality of outlets is configured to transmit water from said first chamber and air from said second chamber to an interior of the hydrotherapy-tub; and wherein the air source comprises ambient air outside said second chamber and at least one outlet of said plurality of outlets is adapted to draw said ambient air from the air source.

2. The system of claim 1 wherein said at least one outlet is adapted to provide said water-air froth through a venturi effect caused by fluid communication of said at least one outlet with water from said water source, when in fluid communication with said first chamber, and air from said air source, when in fluid communication with said second chamber.

3. The system of claim 1 wherein said at least one outlet is adapted to draw air from said second chamber, when in fluid communication with said air source, via a venturi effect.

4. A fluid flow system for a hydrotherapy-tub, said system comprising:

a body configured to be attached to a hydrotherapy tub having an opening through a surface of said tub such that said body covers the opening and said body is immovable and affixed to said surface during operation, said body comprising:

a water inlet and an air inlet;

a first chamber said water inlet configured to extend through the opening to transmit water to said first chamber through the opening;

a second chamber, said air inlet configured to extend through the opening to transmit air to said second chamber through the opening;

a plurality of outlets in fluid communication with said first chamber and said second chamber;

wherein said plurality of outlets is configured to transmit water from said first chamber and air from said second chamber to an interior of the hydrotherapy-tub; and wherein said first chamber comprises a plurality of conical structures for changing a velocity of the water, when said first chamber is in fluid communication with said water source.

5. The system of claim 4 wherein said second chamber further comprises a plurality of air outlets configured to transmit air to said plurality of conical structures, when said second chamber is in fluid communication with said air source.

6. The system of claim 5 wherein said plurality of air outlets extend from said second chamber into said plurality of conical structures.

7. The system of claim 4 wherein said plurality of air outlets is adapted to allow air to be drawn into said plurality of conical structures to cause a plurality of jets of water-air froth to be discharged to an interior of the hydrotherapy tub.

8. The system of claim 7 wherein said plurality of conical structures is adapted to cause said plurality of jets to be discharged via a venturi effect.

9. A fluid flow system for a hydrotherapy-tub, said system comprising:

a body configured to be attached to a hydrotherapy tub having an opening through a surface of said tub such that said body covers the opening and said body is immovable and affixed to said surface during operation, said body comprising:

a water inlet and an air inlet;

a first chamber said water inlet configured to extend through the opening to transmit water to said first chamber through the opening;

a second chamber, said air inlet configured to extend through the opening to transmit air to said second chamber through the opening;

a plurality of outlets in fluid communication with said first chamber and said second chamber;

wherein said plurality of outlets is configured to transmit water from said first chamber and air from said second chamber to an interior of the hydrotherapy-tub; and wherein said plurality of outlets comprises a plurality of air outlets located inside a plurality of water outlets, wherein said plurality of air outlets is in fluid communication with said second chamber and said plurality of water outlets is in fluid communication with said first chamber.

10. The system of claim 9 wherein said plurality of outlets is adapted to draw air through said plurality of air outlets into said plurality of water outlets via a venturi effect to cause a discharge of a plurality of jets of water-air froth to an interior of the hydrotherapy tub.

11. A fluid flow system for a hydrotherapy-tub, said system comprising:

a body configured to be attached to a hydrotherapy tub having an opening through a surface of said tub such that said body covers the opening and said body is immovable and affixed to said surface during operation, said body comprising:

a water inlet and an air inlet;

a first chamber said water inlet configured to extend through the opening to transmit water to said first chamber through the opening;

a second chamber, said air inlet configured to extend through the opening to transmit air to said second chamber through the opening;

a plurality of outlets in fluid communication with said first chamber and said second chamber;

wherein said plurality of outlets is configured to transmit water from said first chamber and air from said second chamber to an interior of the hydrotherapy-tub; and wherein said body is adapted to be mounted to an inner surface of the hydrotherapy tub to cause said a plurality of axes of said plurality of outlets to be substantially perpendicular to said inner surface.

12. A hydrotherapy tub, said tub comprising:

an inner surface having an opening therethrough;

an air source and a water source;

a body mounted to a hydrotherapy tub such that said body covers said opening and said body is immovable and affixed to said inner surface during operation, said body having a first chamber in fluid communication with said water source through said opening and a second chamber in fluid communication with said air source through said opening;

a plurality of outlets adapted to receive water from said first chamber and to receive air from said second chamber;

wherein said plurality of outlets is configured to transmit the water and the air to an interior of the hydrotherapy-tub; and said plurality of outlets adapted to provide a plurality of jets of water-air froth about perpendicular to an inner surface of the hydrotherapy tub.

13. A hydrotherapy tub, said tub comprising:

an inner surface having an opening therethrough;

an air source and a water source;

a body mounted to a hydrotherapy tub such that said body covers said opening and said body is immovable and affixed to said inner surface during operation, said body having a first chamber in fluid communication with said water source through said opening and a second chamber in fluid communication with said air source through said opening;

a plurality of outlets adapted to receive water from said chamber and to receive air from said second chamber;

wherein said plurality of outlets is configured to transmit the water and the air to an interior of the hydrotherapy-tub; and wherein said plurality of outlets is adapted to draw ambient air via a venturi effect.

14. A fluid flow system for a hydrotherapy-tub, said system comprising:

a body configured to be mounted to a hydrotherapy tub having an opening through a surface of the tub such that said body covers the opening and said body is immovable and affixed to said surface during operation, said body comprising a water inlet configured to extend through the opening;

an air inlet configured to extend through the opening, said water inlet and said air inlet being configured to transmit water and air, respectively, through the opening in the wall; and means for providing a plurality of jets of water-air froth to an interior of the hydrotherapy-tub from said body; and wherein said means for providing comprises a means for providing said plurality of jets of water-air froth about perpendicular to an inner surface of the hydrotherapy tub.

15. A method for controlling fluid flow to a hydrotherapy tub, comprising:

mounting a body to a hydrotherapy tub having an opening through a surface of the tub such that the body covers the opening, the body is immovable and affixed to the surface during operation and the body receives water and ambient air through the opening;

providing a plurality of jets of water-air froth to an interior of the hydrotherapy tub from the body; and wherein the providing comprises providing a plurality of jets of water-air froth about perpendicular to an inner surface of the hydrotherapy tub.

* * * * *